United States Patent [19]

Boyd

[11] Patent Number: 4,659,317

[45] Date of Patent: Apr. 21, 1987

[54] METHOD OF MANUFACTURING A COLOR TV FOCUSING MASK

[75] Inventor: David C. Boyd, Corning, N.Y.

[73] Assignee: Corning Glass Works, Corning, N.Y.

[21] Appl. No.: 267,027

[22] Filed: May 26, 1981

[51] Int. Cl.[4] ..... H01J 9/00

[52] U.S. Cl. ..... 445/37; 445/47; 156/644; 430/5

[58] Field of Search ..... 313/402, 403; 430/5; 445/47, 37; 156/644

[56] References Cited

U.S. PATENT DOCUMENTS

| | | | |
|---|---|---|---|
| 2,650,900 | 11/1947 | Holman | 204/11 |
| 4,066,923 | 1/1977 | van Esdonk | 313/402 |
| 4,107,569 | 1/1977 | Ronde | 313/402 |
| 4,121,131 | 1/1977 | van Esdonk et al. | 313/403 X |
| 4,160,311 | 4/1978 | Ronde et al. | 445/37 |
| 4,164,059 | 4/1978 | van Esdonk | 445/47 |
| 4,222,159 | 5/1979 | Koorneef | 445/47 |

*Primary Examiner*—Kenneth J. Ramsey
*Attorney, Agent, or Firm*—B. R. Turner

[57] ABSTRACT

A method of manufacturing a focusing shadow mask for a color cathode ray tube is disclosed in which two conductive plates or surfaces, forming the electrode structure, are secured together by insulating material so that they do not contact each other. Strips or columns of insulating material are accurately located with respect to the matrix of apertures formed in the focus mask by etching cavities which may be in the form of grooves within at least one of the plates forming the electrode structure between adjacent aperture areas, and filling such accurately positioned cavities with a dielectric frit material, and then after firing such frit material etching away the surface of the plate so as to provide raised strips or pillars of insulator material firmly bonded and embedded in the mask structure. Finally, a conductive surface film or second conductive plate is provided on the raised insulating frit material by depositing a film of conductive metallic material on the surface of the frit, such as aluminum deposited by an evaporation technique, or by bonding such second conductive plate to the surface of the insulating frit material.

11 Claims, 6 Drawing Figures

Fig. 4
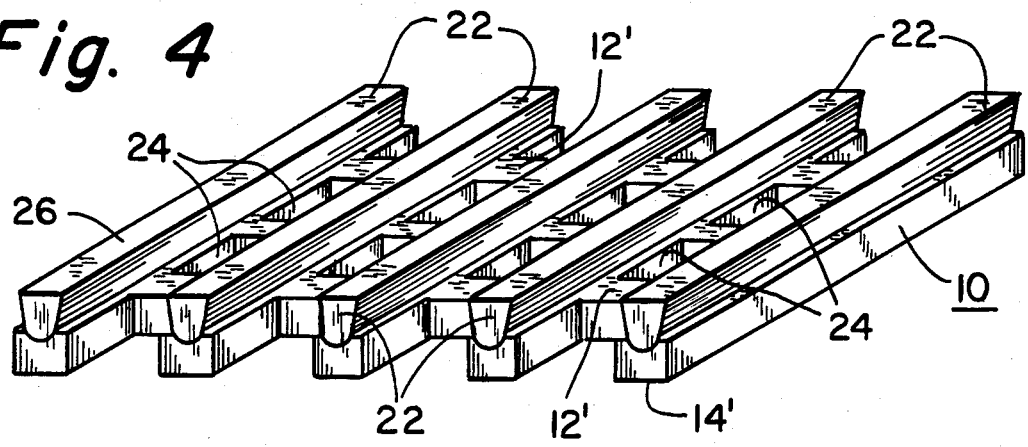
Fig. 5
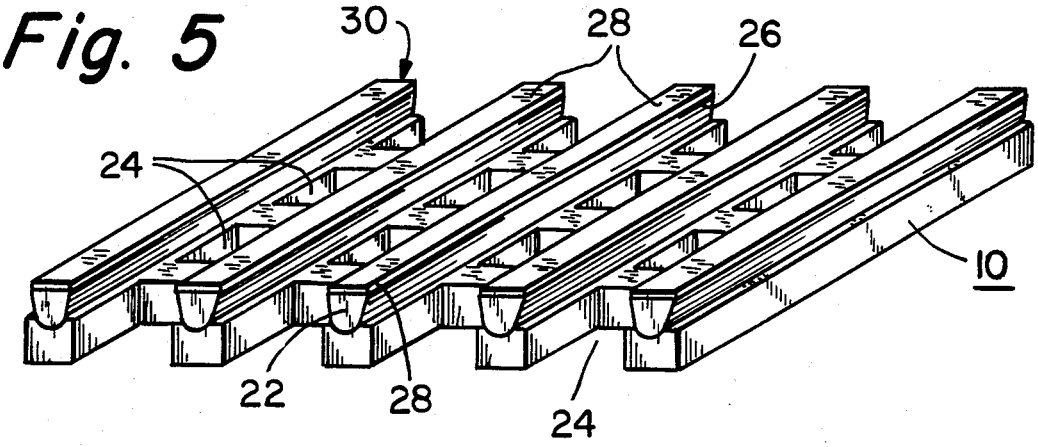
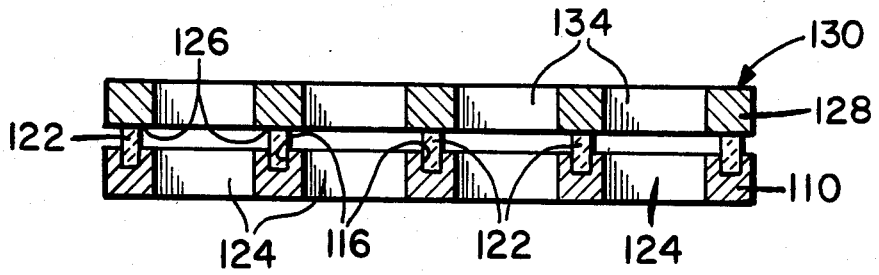
Fig. 6

METHOD OF MANUFACTURING A COLOR TV FOCUSING MASK

BACKGROUND OF THE INVENTION

The invention is directed to a method of manufacturing a color television focusing mask for TV tubes which include an evacuated envelope, an electrode system to generate at least two electron beams, a display screen covered with a large number of regions luminescing in different colors, and color selection means arranged a short distance in front of the display screen for assigning each electron beam to luminescent regions of one color. The color selection means usually used is in the form of a perforated plate, known as a shadow mask, which is arranged at a short distance in front of or before the display screen. A drawback of such a shadow mask is that a large part, for example 80-85%, of the electrons are intercepted, which imposes restrictions upon the maximum achievable brightness of the displayed picture. When the shadow mask, however, is replaced by a focusing mask, such as is known in the industry, many more electrons are on target and the brightness of the picture is increased substantially, or in the alternative reduced voltages may be utilized to maintain the brightness achieved with conventional shadow masks.

Focus masks, such as shown in U.S. Pat. Nos. 4,066,923; 4,160,311; 4,164,059; and 4,222,159 are known in the prior art and may consist of a sheet or set of interconnected conducting strips which form one system of lens electrodes connected mechanically by means of insulating material to an apertured plate or second set of conducting strips which form another set of lens electrodes. As shown by the various manufacturing methods employed in said aforementioned patents, one of the problems encountered in manufacturing such focus masks was that of precisely locating the strips or columns of insulation with respect to the apertures within the mask, and then positioning another conductor on top of the strips or columns so as to be in desired orientation with respect to such apertures. In U.S. Pat. No. 4,066,923, an etched grid plate and etched apertured plate are first coated with layers of gold and then pressed against an insulating foil which is coated on both sides with layers of copper to effect a diffusion bond between the layers of copper and gold. The uncovered parts of the copper layers are then etched away to form the apertures through the mask.

In the method set forth in U.S. Pat. No. 4,160,311, a metal plate is first etched so as to provide a relief pattern having a plurality of ridges separated by strip-shaped regions having a small thickness. A suitable insulator in the form of glass powder may then be applied to the upper faces of the ridges by utilizing an electrophoresis bath and protecting those parts of the ridged plate not to be covered with the glass powder by use of a suitable protector material. The protected material is then removed and the glass powder is converted into a solid glass by heating, and a ridged plate is obtained which has a relief and a layer of solid glass on the ridges. Such plate may then be placed against an apertured plate or against another plate having a similar relief and the plates secured together by heating. The strip-shaped regions are then removed by etching and a grid shaped focus mask having a pair of apertured plates separated by insulating glass strips is provided.

In the process disclosed by U.S. Pat. No. 4,164,059, a color selection means or focusing mask is formed by first coating two sides of the polyimide foil with layers of metal which are then provided with a photoresist material and exposed to develop a pattern of parallel metal strips on each side of the polyimide foil, with the parallel strips on one side of the foil extending 90° to the parallel strips on the opposite side. The portions of the foil disposed between the strip conductors are then etched away without attacking the conductors such that only blocks of the original foil remain in areas where the conductors on one side cross the conductors on the other side.

U.S. Pat. No. 4,222,159 sets forth various methods of producing color selection means or focus masks including a continuous method utilizing a roll of polyimide foil covered with a metallic film and a roll of metal plate material having apertures formed therein. The roll of polyimide foil which is covered with a metal film is cut into a plurality of strips to form electrodes, and the roll of metal plate having apertures formed therein is continuously fed under a pressure roll which presses the electrode strips between the apertures of the metal plate, which is covered with a polyamide solution. Strips of lens electrodes are then guided through a high frequency furnace which converts the polyamide into polyimide and the strips are cut into plates or focusing masks wherein the metal plate is insulated from the electrode strips by the polyimide foil.

According to U.S. Pat. No. 4,107,569, the relevant electrodes of the focus mask are kept at a defined distance from each other by grains of an electrically insulating material such as $Al_2O_3$ present between the facing surfaces of the electrodes, which grains are sunk on two sides in layers of adhesive material present on the two surfaces of the electrodes. In the focus mask set forth in U.S. Pat. No. 4,121,131, apertures are first etched into a pair of opposed iron plates and glass fibers consisting of a hard glass core and a soft glass jacket are positioned on the plates between the rows of the apertures and heated in a furnace to the softening temperature of the glass jacket. Finally, as shown in U.S. Pat. No. 2,650,900, a complex method is set forth for producing a metal mesh screen wherein a sheet of thermoplastic material is impressed with an exact copy of the original groove system which is coated with a thin film of suitable metal. The coated surface is then lightly lapped until the metal film is removed from portions of the surface lying between the grooves, leaving such portions clean and nonconductive, whereas a continuous conductive film or layer remains within the grooves. The matrix is then placed in an electro-deposition bath and a further metal deposit is applied to the metal already in the groove, which reinforces the otherwise mechanically weak structure of the previously deposited metal film. The sheet of thermoplastic material is then heated and the completed mesh removed from the grooves.

The present invention materially simplifies the manufacture of focus masks by easily and efficiently locating strips or columns of insulating material with respect to the holes or apertures formed in the focus mask and then easily and simply applying another conductor or plate on top of the strips or columns.

SUMMARY OF THE INVENTION

In its simplest form, the present invention sets forth a completely new concept in precisely locating columns or strips of insulating material with respect to the holes or apertures formed within a conducting plate of a focus mask and for applying a second conductor upon the strips or columns of insulating material.

By utilizing well known photoetching techniques, a plurality of cavities which may be in the form of partial holes or grooves are etched into one side of a sheet or plate of steel or the like from which the mask is to be formed, and indentations of the shape and location of the desired holes or apertures are preferably simultaneously etched in the opposite side of the plate. The etched groove or hole-like cavities are formed about 25% deeper than the desired thickness of the dielectric separating the conductive surfaces of the mask. The excess photoresist material is then washed or removed from the plate and the resulting cavities are filled with a frit mixture of desired dielectric such as by use of a doctor blade or similar method. The frit material, besides having the desired electrical properties, is resistant to the metal etching solution and provides a good bond with the metal after the frit is fired. The entire mask structure is then etched so as to complete the formation of the aperture holes through the mask and relieve the metal surface about the frit material so that it emerges on the receded surface as a plurality of raised strips or columns of insulator material firmly bonded and embedded in the mask. Finally, aluminum or other suitable metal may be deposited on the surface of the glass frit such as by evaporation techniques, or a second apertured conductive plate may be bonded to the surface of such insulator strips or columns.

It thus has been an object of the present invention to overcome the problems encountered in the prior art with respect to the manufacture of focusing masks for color television by setting forth an efficient and inexpensive method of precisely locating dielectric material with respect to apertures or openings within a focusing mask and between opposed electrically conducting surfaces.

BRIEF DESCRIPTION OF THE DRAWINGS

FIG. 4 illustrates the final etching step wherein the upper surface of the metal sheet is etched intermediate the fired frit material, leaving the durable frit material untouched so that it emerges on the now receded surface as raised strips of insulator material firmly bonded and embedded in the mask, and the holes or apertures are etched through on the reverse side of the plate in exactly the correct alignment.

FIG. 5 illustrates the depositing of a conductive material on the surface of the raised glass insulator strips.

FIG. 6 is a cross sectional view in elevation of a further embodiment of the invention, wherein a plurality of spaced apart insulator columns are formed between the apertures or holes for maintaining the opposed conducting surfaces of the focus mask in spaced relation.

DESCRIPTION OF THE PREFERRED EMBODIMENTS

Figure 1:
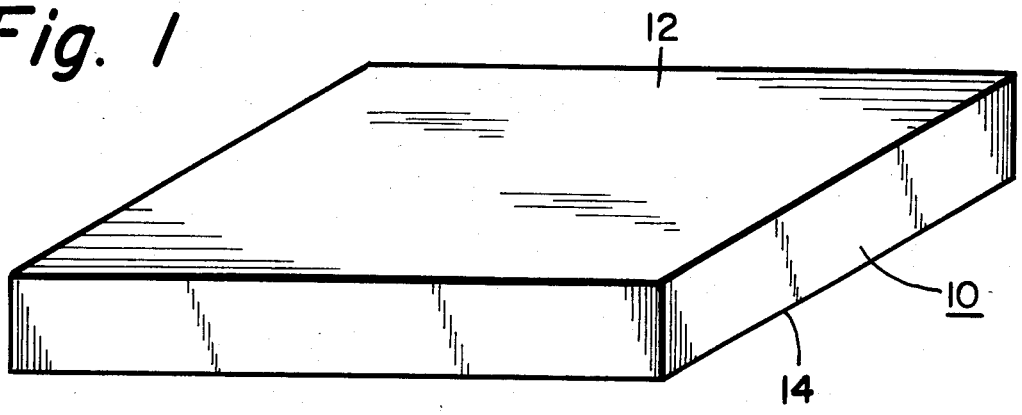
FIG. 1 is a perspective view with enlarged thickness of a sheet of metal from which a focusing mask is to be formed.
Figure 2:
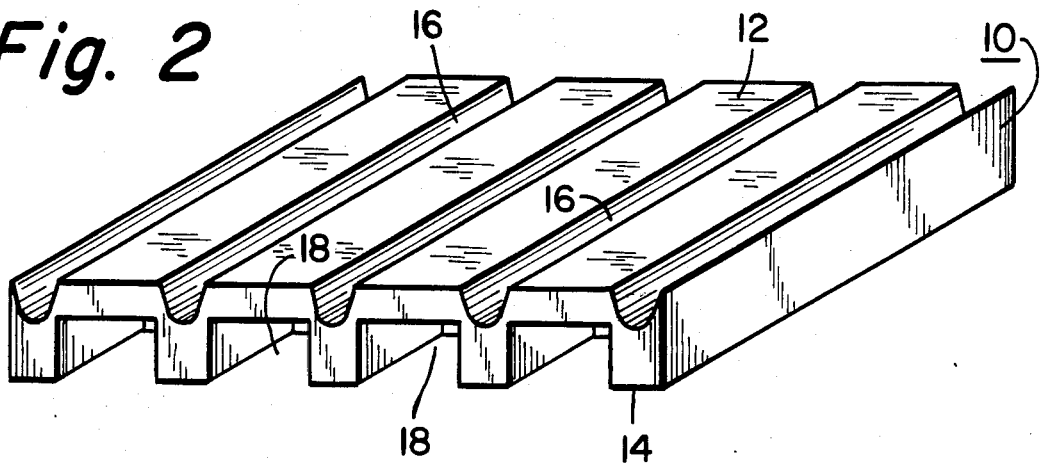
FIG. 2 is a perspective view showing the etching of groove-like cavities on one side of the metal sheet and the simultaneous etching of indentations on the opposite side in the shape and location of the desired apertures.

Referring now to the drawings, a blank sheet of metal 10, which may be steel, is shown in FIG. 1 with an enlarged thickness so as to better illustrate the invention. Actually, due to the etching process to be performed on the sheet 10, the thickness of the sheet 10 should be slightly greater than the desired thickness of the apertured conductive member formed therefrom and may have an initial thickness of about 0.008 inches. A layer of photoresist material is then provided on the two surfaces of the sheet 10 in a desired pattern, such that one layer is converted by photographic exposure and development into a pattern of cavities in the form of parallel grooves on surface 12, and the other into a pattern of rectangular recesses in surface 14. The portions of the surfaces 12 and 14 exposed after development, are removed by means of a suitable etching liquid and the remaining photoresist material is washed from the surfaces thus producing a plurality of etched grooves 16 in surface 12 and a plurality of etched recesses 18 in surface 14. The groove-like cavities are offset with respect to said recesses so as not to overlie said recesses when the surfaces 12,14 are horizontal. The grooves 16 are etched about 25% deeper than the desired thickness of the dielectric material for separating the opposed conducting surfaces, so that a portion of the dielectric will remain embedded within the sheet 10.

Figure 3:
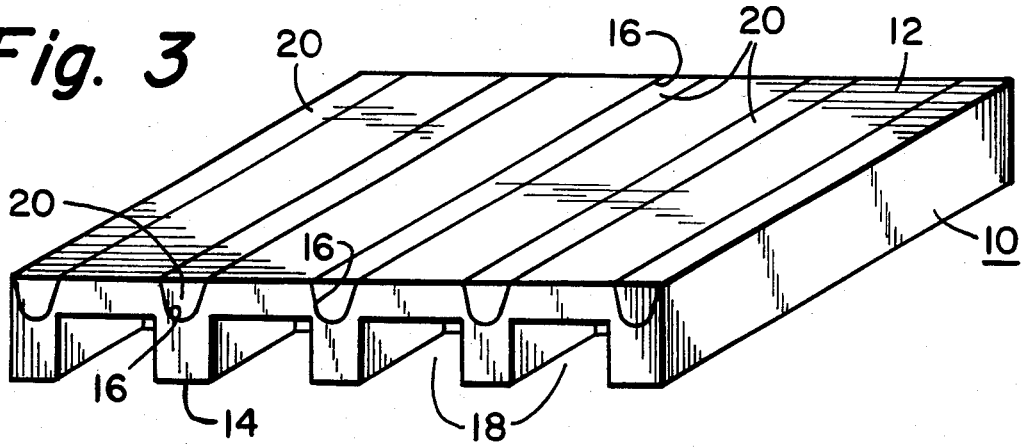
FIG. 3 illustrates the etched sheet of FIG. 2 having the grooves filled with a dielectric frit material which is fired or sintered into a durable dielectric separator.

The grooves 16 are then filled with a suitable frit material 20 of desired dielectric as shown in FIG. 3, such as by use of a doctor blade or similar method so as to level the surface of the frit material 20 with surface 12 and leave surface 12 free of frit material. Besides having dielectric properties, the glass frit should be resistant to the metal-etching solution and should form a good bond with the metal plate when fired. Dielectric frit materials such as disclosed in Canadian Pat. No. 639,319 and U.S. Pat. No. 2,466,849 appear to fulfill the desired requirements. The frit material such as shown at 20 in FIG. 3 is then fired into durable insulator strips 22 and the entire sheet or plate 10 is then etched so as to remove or relieve surface 12 between the insulator strips 22 to a depth less than that of the grooves 16 such that the strips 22 emerge on the now receded surface 12' as a plurality of raised insulator strips firmly bonded and still partially embedded in the sheet or panel 10 for forming the mask.

In addition, the recesses 18 formed in surface 14 are completely etched through the sheet 10 to form rectangular apertures or holes 24 in precise alignment between the dielectric or insulator strips 22, and of course surface 14 will have also been etched down to surface 14'. Finally, as shown in FIG. 5, a completed focus mask 30 is shown comprising the apertured sheet 10, the dielectric insulator strips 22, and a film or layer of conductive material 28 formed on the surface 26 of the insulator strips 22. The conductive surface 28 may be in the form of aluminum which is deposited upon the surface 26 of the insulator strips 22 by an evaporation technique. Alternatively, a second apertured conductive plate may be bonded to the surface 26 so as to form the focus mask 30 having a pair of conductive surfaces separated by the precisely located dielectric material 20.

Referring now to FIG. 6, a further embodiment of a focus mask 130 is shown having a lower conductive sheet or surface 110 and an upper conductive sheet or surface 128 separated by a plurality of dielectric insulator columns or pillars 122. The sheet 110 is formed in the same manner as sheet 10 except that in place of grooves 16, a plurality of hole-like cavities 116 are etched in the upper surface thereof and filled with frit material which is fired to form a plurality of columns or pillars 122 when the plate 110 is subsequently etched to form apertures or holes 124 together with the raised columns or pillars 122. Conductive surface or plate 128 having aligned apertures 134 is then bonded to the upper surfaces 126 of the columns or pillars 122.

In both embodiments of the focus masks shown in FIGS. 5 and 6, the dielectric supporting material 20, whether in the form of insulator strips 22 or insulator columns or pillars 122, dielectrically separate opposing conductive surfaces or plates 10, 28 or 110, 128 and are precisely located with respect to the apertures 20 or 120, 134 extending through such focus masks 30, 130, respectively. It will be understood, of course, that both masks function in the same manner as those focus masks set forth in the earlier cited prior art.

Although the now preferred embodiments of my invention have been set forth, it will be apparent to those skilled in the art that various changes and modifications may be made thereto without departing from the spirit and scope of the invention as set forth in the appended claims.

I claim:

1. A method of making a color television focusing mask which comprises, forming a plurality of recesses in a first surface on one side of a sheet of metal, forming a plurality of cavities in a second surface on the opposite side of said sheet of metal, said cavities being offset with respect to said recesses so as to not overlie said recesses when said surfaces are horizontal, thereafter filling said cavities in said second surface with a dielectric frit material, firing said frit material to form durable dielectric portions which are bonded to said sheet of metal, relieving the second surface of said sheet of metal to a depth which is less than the depth of the cavities formed in said second surface to provide said dielectric as raised insulator portions firmly bonded to and partially embedded within said sheet of metal, forming apertures through said sheet of metal adjacent said insulator portions, and providing a conductive surface on said insulator portions in spaced apart relation from said sheet of metal so as to provide a focusing mask having opposed conductive surface portions separated by insulator portions positioned adjacent apertures extending through said mask.

2. A method of making a color television focusing mask as defined in claim 1 including the steps of etching said plurality of recesses in said first surface and etching said plurality of cavities in said second surface of said sheet of metal.

3. A method of making a color television focusing mask as defined in claim 2 wherein said recesses and said cavities are simultaneously etched in opposite sides of said sheet of metal.

4. A method of making a color television focusing mask as defined in claim 1 including the steps of forming said plurality of cavities in the shape of a plurality of parallel grooves extending across said second surface, filling said parallel grooves with dielectric frit material up to a level substantially even with said second surface, etching said second surface adjacent said grooves of frit material to a desired depth and providing raised insulator strips firmly bonded to and extending across said sheet of metal and having a surface spaced from said etched second surface.

5. A method of making a color television focusing mask as defined in claim 1 including the steps of etching a plurality of rows of individual cavities in said second surface, filling said cavities to a level substantially equal to said second surface with a dielectric frit material, and etching away said second surface to a desired depth to provide a plurality of rows of raised insulator columns which are firmly bonded to said metal sheet and have surfaces spaced from said etched surface.

6. A method of making a color television focusing mask as defined in claim 4 including the steps of depositing a metal coating on the spaced surface of said raised insulator strips so as to provide a pair of conductive surfaces separated by said insulator strips which are positioned adjacent the apertures extending through said focusing mask.

7. A method of making a color television focusing mask as defined in claim 5 including the steps of bonding a second apertured metal sheet to the spaced surfaces of said insulator columns so as to provide a pair of conducting surfaces separated by said insulator columns adjacent the apertures extending through said focusing mask.

8. A method of making a color television focusing mask as defined in claim 1 including the step of forming said apertures through said sheet of metal by etching said recesses completely through said metal sheet to form apertures extending therethrough.

9. A method of making a color television focusing mask as defined in claim 1 including the step of etching said cavities in said second surface of said sheet of metal to a depth approximately 25% greater than the desired height of the resulting raised insulator portions.

10. A method of making a color selection structure for a cathode ray tube which comprises, forming a plurality of recesses in a first surface on the side of a sheet of metal, forming plurality of cavities in a second surface on the opposite side of said sheet of metal, thereafter filling said cavities in said second surface with a dielectric material, firing said material to form durable dielectric portions which are bonded to said sheet of metal, relieving the second surface of said sheet of metal to provide said dielectric as raised insulator portions and forming in the region of said recesses apertures through said sheet of metal adjacent said insulator portions, and providing a conductive surface on said insulator portions in spaced apart relation from said sheet of metal so as to provide a focusing mask having conductive surface portions separated by insulator portions positioned adjacent apertures extending through said mask.

11. A method of making a color selection structure for a cathode ray tube which comprises, forming a plurality of recesses in a first surface on one side of a sheet of metal, forming a plurality of cavities in a second surface on the opposite side of said sheet of metal, said cavities being offset with respect to said recesses so as to not overlie said recesses when said surfaces are horizontal, thereafter filling said cavities in said second surface with a dielectric frit material, firing said frit material to form durable dielectric portions which are bonded to said sheet of metal, relieving the second surface of said sheet of metal to provide said dielectric as raised insulator portions and to form in the region of said recesses apertures through said sheet of metal adjacent said insulator portions, and providing a conductive surface on said insulator portions in spaced apart relation from said sheet of metal so as to provide a focusing mask having opposed conductive surface portions separated by insulator portions positioned adjacent apertures extending through said mask.

* * * * *